US007377465B2

(12) United States Patent
Hanusiak et al.

(10) Patent No.: US 7,377,465 B2
(45) Date of Patent: May 27, 2008

(54) WIRE/FIBER RING AND METHOD FOR MANUFACTURING THE SAME

(75) Inventors: William Hanusiak, Bridgeport, WV (US); Lisa Hanusiak, Bridgeport, WV (US); Steven Spear, Bridgeport, WV (US); Charles Rowe, Wheeling, WV (US); Jeffery Parnell, Chelmsford, MA (US)

(73) Assignee: Sequa Corporation, Hackensack, NJ (US)

( * ) Notice: Subject to any disclaimer, the term of this patent is extended or adjusted under 35 U.S.C. 154(b) by 0 days.

(21) Appl. No.: 11/512,218

(22) Filed: Aug. 30, 2006

(65) Prior Publication Data

US 2007/0181733 A1 Aug. 9, 2007

Related U.S. Application Data

(62) Division of application No. 10/901,553, filed on Jul. 29, 2004, now Pat. No. 7,118,063.

(51) Int. Cl.
*H01G 4/32* (2006.01)

(52) U.S. Cl. ..... 242/444.4; 242/444.1

(58) Field of Classification Search ..... 242/443, 242/444, 444.1, 444.3, 444.4; 428/615; 419/4, 419/5

See application file for complete search history.

(56) References Cited

U.S. PATENT DOCUMENTS

| | | | | | |
|---|---|---|---|---|---|
| 2,533,717 | A | * | 12/1950 | Coursey | 242/444.1 |
| 2,944,753 | A | * | 7/1960 | Odell et al. | 242/444.1 |
| 3,915,776 | A | | 10/1975 | Kaempen | 156/161 |
| 3,955,127 | A | * | 5/1976 | Hunt | 361/323 |
| 4,129,929 | A | * | 12/1978 | Kessler | 29/25.42 |
| 4,417,701 | A | * | 11/1983 | Moritz | 242/431 |
| 4,772,352 | A | * | 9/1988 | Kornbichler | 156/425 |
| 5,460,774 | A | | 10/1995 | Bachelet | 419/5 |
| 5,763,079 | A | | 6/1998 | Hanusiak et al. | 428/377 |
| 2003/0188415 | A1 | | 10/2003 | Kenney et al. | 29/428 |

* cited by examiner

*Primary Examiner*—Emmanuel M Marcelo
(74) *Attorney, Agent, or Firm*—Nixon & Vanderhye PC

(57) ABSTRACT

A wire/fiber ring having two layers applied in four clock positions. Each layer includes a first material strand having a first diameter and a second material strand having a second diameter different from the first diameter. A second or any subsequent layer is disposed such that there is unambiguous nesting between strands in adjacent layers. After the array is built-up, wire is over-wrapped around the array to hold it in place during subsequent consolidation steps, which take place after the built-up array is sealed in an air-tight container and evacuated. After heating and application of pressure a wire/fiber array having a void content of about 12% and a fiber content of between about 0% to 70% and preferably between about 30% and 45% can be achieved.

12 Claims, 14 Drawing Sheets

WIRE/FIBER RING AND METHOD FOR MANUFACTURING THE SAME

CROSS RELATED APPLICATION

This is a divisional application of U.S. patent application Ser. No. 10/901,553 filed Jul. 29, 2004, now U.S. Pat. No. 7,118,063 the entirety of which application is incorporated by reference.

The present invention is directed to wire/fiber rings, and more particularly to an improved matrix composite wire/fiber ring having improved void and fiber fractions, and a method of manufacturing the improved matrix composite wire/fiber ring.

BACKGROUND AND SUMMARY OF THE INVENTION

Titanium matrix composite (TMC) rings are useful in high temperature rotating parts, such as turbine engines, where specific stiffness and strength are critical to design. While affordability issues generally have hampered the use in production of these materials, one TMC fabrication method has shown promise. According to this method titanium wire and silicon carbide (SiC) fiber are combined to form a hoop reinforcement array. Methods for fabricating TMC rings in this way have been described in U.S. Pat. No. 5,763,079 to Hanusiak et al. and U.S. Pat. No. 5,460,774 to Bachelet. These two patents describe different approaches to achieve the same end. However, both also restrict manufacturing flexibility in ways critical to design.

The method described by Hanusiak et al. is illustrated in FIGS. 1A-1C. In this approach, the combination of wire 3 and fiber 4 is restricted to a one-to-one ratio, but the wire diameter and the fiber diameter can be different as long as the wire 3 diameter is greater than that of the fiber 4. The selection of wire and fiber diameter establishes the fiber fraction in the resultant composite. For example, using a 0.007 inch diameter wire and a 0.0056 diameter fiber results in a composite with a fiber fraction of 30%. In accordance with Hanusiak et al., the assembly consists of one tape containing all wire elements and one tape containing all fiber elements combined to form two layers per ply. Each tape is made up of equal-sized elements, but the elements in the first tape do not have to be the same size as the elements in the second tape. The assembly is built up using alternate tapes of each type applied to a winding core in such a way that adjacent fibers 4 do not come in contact with each other. The advantage of the structure according to Hanusiak et al. is that the ratio of wire-to-fiber diameters can be varied such that composites with fiber fractions between 35% and 45% can be readily fabricated. Such a range of fiber fractions is particularly desirable for effective ring construction. The disadvantage of the structure according to Hanusiak et al., however, is that the assembled array contains about 20% void, which is particularly detrimental in thick parts because it allows for undesirable cusp formation during metal movement. Moreover, the structure according to Hanusiak et al. has been shown to be organizationally unstable during a consolidation cycle to remove the void content of the TMC part.

FIG. 1A shows a cross-section of a composite ring structure 1 according to Hanusiak et al. wherein there is maximum fiber spacing such that wires 3 touch in the height direction only. FIG. 1B shows an embodiment in accordance with Hanusiak et al. wherein there is median fiber spacing such that the fibers are spaced equally in width and in height.

FIG. 1C depicts yet another configuration of a structure in accordance with Hanusiak et al. wherein there is minimum fiber spacing and wires 3 touch each other in the lateral or width direction only.

The method described by Bachelet is illustrated in FIGS. 2A-2C. According to Bachelet, the wire/fiber combination is restricted to a two-to-one or a three-to-one ratio. Additionally, in all of the examples disclosed by Bachelet, the wire diameters are limited to the same dimension as the fiber diameters. All assemblies utilize two layers per ply and fall into three types as shown in FIGS. 2A-2C.

Specifically, as shown in FIG. 2A, each layer is made up of fibers 4 separated by two equivalent-diameter wires 3, and the second layer is laterally indexed so that the fibers 4 nest between the two wires 3 in the layer below.

In other variations of the Bachelet structure, as shown in FIGS. 2B and 2C, one layer is made up of fibers 4 separated by one equivalent-diameter wire 3. The second layer is made up of all wires 3 of the same diameter as the fibers 4 in the first layer. The advantage to the Bachelet approach is that the void content is only about 10%, and the array apparently is organizationally stable during subsequent consolidation steps. Furthermore, the Bachelet approach, because of the resulting relatively low void fraction, may be desirable for thick parts since there is a lower tendency for cusp formation along the TMC perimeter. The disadvantage, however, of the Bachelet approach is the limitation in the examples to equal diameters for the wires and fibers, which limits the fiber fraction to 25% or 33%. These fiber fractions are not in the most desirable range from a design standpoint. That is, in many designs, a 40% fiber fraction is desirable to achieve a useful performance increase.

Additionally, all examples disclosed in the Hanusiak et al. and Bachelet patens are limited to equal-sized elements in any single layer. Although those references do not specifically exclude the case where elements in a layer may have different diameters, neither reference addresses the special problems associated with such a structure. Namely, when dissimilar-sized elements are provided in a single layer and all elements in a layer are applied to the winding core simultaneously there occurs an inherent stacking, or organizational, instability.

It is noted that simultaneous application of all elements in any single layer is a specific requirement of Bachelet. Bachelet apparently applies this constraint to control the element spacing in the first layer, since the reference fails to describe any other method for spatially controlling elements in the first layer on a winding mandrel. This also implies that the elements in the first layer are touching in order to effectively fulfill the positioning goal. Subsequent layer element positions are thus defined by gaps created between elements in the first layer. Given a first layer with touching elements, and dissimilar wire and fiber diameters, subsequent layer elements will typically lose their track due to nesting site ambiguity and the assembly will fall into disarray. FIGS. 3A-3C depict how a second layer of non-equal sized elements might be disposed on a first layer of non-equal sized elements and how, ultimately, after several layers have been applied, substantially all order is lost (FIG. 3C). That is, the non-equal element size in a given layer creates competition for nesting sites if the subsequent layer elements arrive at the same time.

Thus, there is a need for an improved method for achieving low void content in a stable array, concurrently with flexibility in fiber fraction between about 0% to 70% and preferably between about 30% and 45%.

SUMMARY OF THE INVENTION

Accordingly, it is an object of the present invention to provide an improved TMC wire/fiber ring structure and a method of manufacturing the same wherein there is an unambiguous position choice for each element in each layer.

It is a further object of the invention to provide a TMC wire/fiber ring that is low in void and has fiber fraction within a desirable range.

It is a further object of the present invention to provide a TMC wire/fiber ring that comprises elements of different diameters in a single layer.

It is still another object of the present invention to provide a winding mandrel that provides unambiguous positions for a first layer of wire and/or fiber.

Another object of the present invention is to define and implement a hardware set and associated elements to achieve a stable and efficient consolidation process.

To achieve these and other objects, the present invention provides a composite ring having as a first layer a plurality of first strands or elements each having a first diameter and being spaced from each other with a predetermined distance. A plurality of second strands each having a second diameter different from the first diameter, are disposed such that at least two of the second strands fit between adjacent first strands, thereby completing the first layer.

As a second layer, a plurality of third strands having the same diameter as the first strands are disposed offset from the first strands such that the third strands overly a region between the second strands in the first layer. Finally, a plurality of fourth strands having the same diameter as the second strands, are disposed offset from the second strands such that a region between adjacent fourth strands is disposed over the center of the third strands. The resulting overall configuration is a two layer structure obtained with four tapes, i.e., four sets or bundles of strands.

In a preferred embodiment of the invention, the first, second, third and fourth strands comprise at least one of fiber and wire. The fiber preferably comprises silicon carbide and the wire preferably comprises titanium such that a TMC wire/fiber ring is obtained.

Also in accordance with the present invention, the fiber strands preferably have diameters larger than the wire strands. Such a construction results in a fiber fraction of approximately between 30% and 45% and a void fraction of about 12%.

In a preferred embodiment of the method in accordance with the present invention, a mandrel having grooves that correspond respectively to desired locations for each strand of the first layer is provided for winding the TMC part. Accordingly, nesting sites in the first layer are properly arranged for the second and any subsequent layers. Alternatively, "grooves" can be achieved by providing on the mandrel a layer of wire having a selected diameter, resulting in predetermined nesting sites, consistent with the desired spacing for the first strand layer.

In accordance with the method of the present invention, tapes comprising the plurality of strands are wound simultaneously, but each tape is applied to the mandrel at different tangential, or "clock," positions. Winding is continued until the desired thickness is achieved. In accordance with preferred embodiments, the strands may or may not contact each other in a lateral direction.

Further in accordance with a preferred embodiment of the present invention, after winding is complete an exposed layer of the strands preferably is over-wrapped with over-wrap wire to preserve the array pattern.

A hardware set to produce the wire/fiber array of the present invention preferably includes the mandrel, a pair of side rings extending radially outward from a winding surface of the mandrel, and a closure ring contacting at least a portion of the side rings and enclosing an assembly space defined by the winding surface, inside surfaces of the side rings and an inside surface of the closure ring.

The side rings preferably include a relief cut to facilitate contraction during consolidation, and the winding surface preferably comprises a shoulder against which the side rings abut.

The side rings preferably also include a groove on a top portion thereof to accommodate an end portion of the over-wrap wire. When fully assembled, the closure ring preferably is in contact with over-wrap wire that surrounds a built-up wire/fiber assembly disposed in the assembly space.

In accordance with the present invention, there is also provided a winding apparatus that includes the winding mandrel, a plurality of guide rollers each arranged at a predetermined location circumferentially around the winding mandrel, and a plurality of tapes, each being guidable by one of the plurality of guide rollers, each of the tapes comprising a plurality of strands. When the winding mandrel is rotated, each of the tapes is disposed, successively, one on top of the other on the winding mandrel.

Further in accordance with the present invention there is provided a method of processing a "green" wire/fiber array, including the steps of winding a plurality of strands on a winding mandrel with the strands being confined thereon by side rings associated with the mandrel, over-wrapping the plurality of strands with over-wrap wire, and thereafter enclosing the strands and the over-wrap wire with a closure ring in an assembly area space defined by the winding mandrel, inside surfaces of the side rings and an inside surface of the closure ring. The winding mandrel, side rings and closure ring can be defined as a hardware set.

The hardware set preferably is then encapsulated in an air tight container which is subsequently evacuated via tubes through which an inert gas, such as argon, preferably is forced.

After the sealed container is fully evacuated and all contaminants and undesirable gases have been eliminated, the container is sealed and a consolidating step preferably ensues.

This consolidating step preferably includes heating the strands to about 1650° F. under pressure of up to 15,000 psi. Under such conditions, the side rings move laterally and the wire/fiber array consolidates to a point where it can thereafter be machined into, for example, a turbine disc, as if it were monolithic material.

BRIEF DESCRIPTION OF THE DRAWINGS

The present invention will be more fully understood upon reading the following Detailed Description in conjunction with the accompanying figures, in which reference numerals are used consistently to indicate like elements, and in which.

DETAILED DESCRIPTION OF THE PREFERRED EMBODIMENTS

The preferred embodiments of the present invention will now be described with reference to FIGS. 4A-E and FIG. 5. In accordance with the present invention, an improved method has been identified that achieves a wire/fiber ring having a low void content and a stable array concurrently with flexibility in fiber fraction of between about 0% to 70% and preferably between about 30% and 45%.

In accordance with the present invention, stacking is controlled such that two layers are built-up using four tapes in four operations as shown in FIGS. 4A-4E, and FIG. 5. By controlling the stacking in this way stability problems that plague the prior art are overcome. As shown, dissimilar-sized elements can be stacked reliably by applying the elements to a winding core, or mandrel 50, using four tapes 56*a-d* applied in four sequential clock positions 58*a-d*. At each clock position a tape of all equal sized wires or all equal sized fibers are applied to the winding core. The selection of elements in a given tape and the sequence of application of tapes are designed to achieve the desired assembly. In accordance with the present invention, there is always an unambiguous position choice for each element in each layer at the time of application to the winding core, even though wires and fibers having different diameters are used.

Figure 4A:
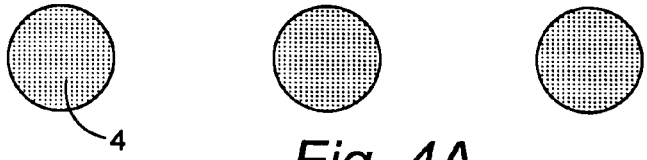
FIGS. 4A-E illustrate a preferred embodiment of assembling a TMC wire/fiber ring in accordance with the present invention.
Figure 4B:
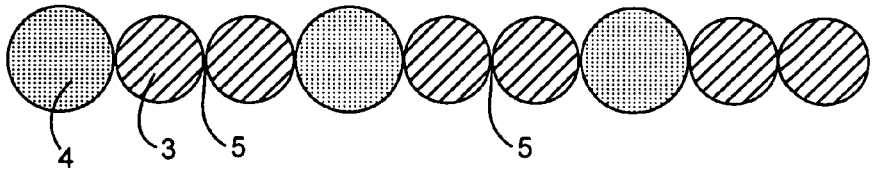
Figure 4C:
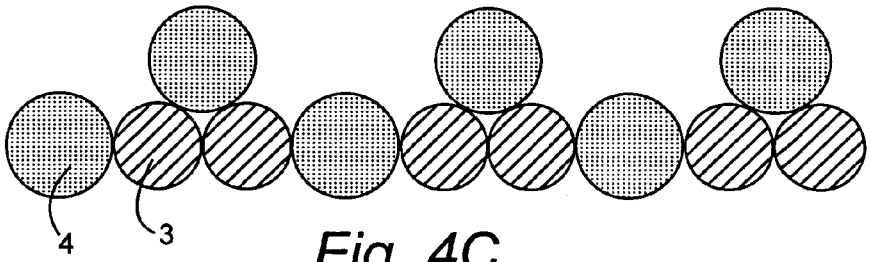
Figure 4D:
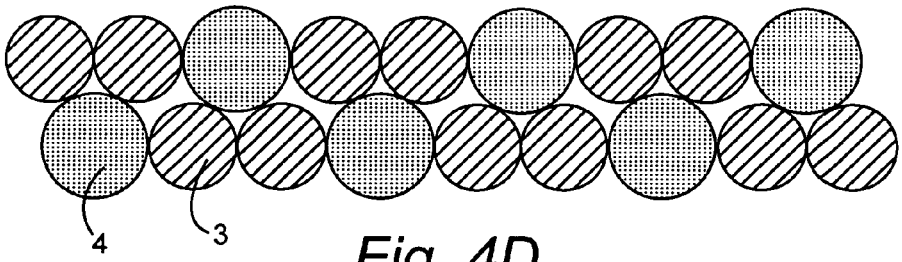
Figure 4E:
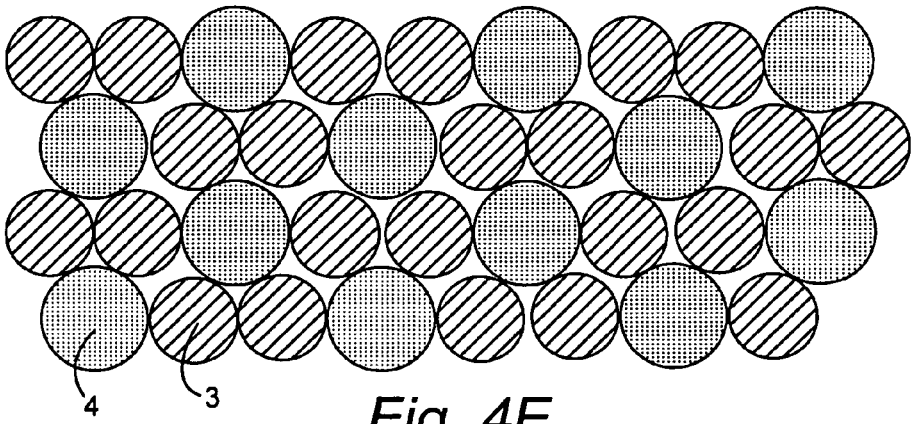

Specifically, in FIG. 4A a plurality of fibers 4 are first disposed. In FIG. 4B a plurality of wires 3 are disposed in the same layer as the first fibers 4. In a preferred embodiment, the distance between the first fibers is set so that two wires 3 fit between two adjacent fibers 4. In the third clock position as shown in FIG. 4C, a second layer is formed first with fibers 4. These fibers 4 are disposed such that each overlays a junction 5 between the wires. Then, as depicted in FIG. 4D, a plurality of wires 3 are disposed to fill the gaps between adjacent fibers 4 and thereby complete the second layer. The process is repeated as many times as necessary to achieve a desired thickness. FIG. 4E depicts a four layer structure, i.e., two two-layer structures in accordance with the present invention.

In accordance with the preferred embodiment, the resulting array (FIG. 4D, 4E) has a void fraction of about 12%, which is relatively low, and therefore desirable. On the other hand, in accordance with the present invention, the fiber fraction can easily be controlled to be of any value in the range of interest by choosing wires/fibers with relative diameters that provide the desired fractional ration.

Figure 5:
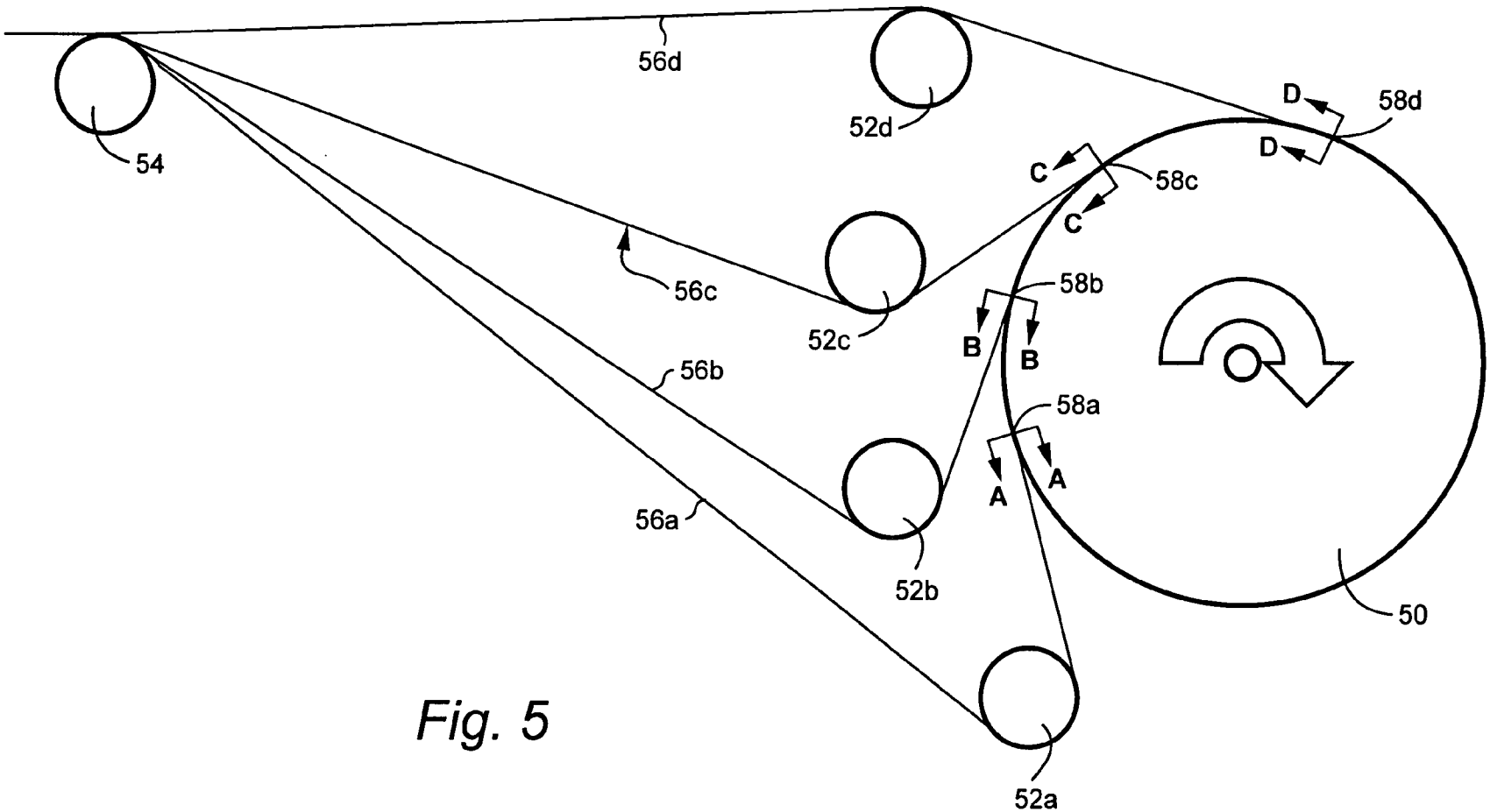
FIG. 5 illustrates a winding apparatus in accordance with the present invention.

FIG. 5 illustrates an apparatus for applying one ply, i.e., two layers using four tapes. As shown, the individual tapes 56*a-d* arrive at the mandrel 50 at four predetermined clock positions 58*a-d* to facilitate controlled nesting of the plurality of strands. The apparatus shown in FIG. 5 includes a lead roller 54 and a plurality of guide rollers 52*a-d* that are arranged respectively around the mandrel 50 so that the individual tapes 56*a-d* are applied to the mandrel 50 in the desired clock position.

As noted in the summary section above, the fibers preferably comprise SiC and the wire preferably comprises titanium. However, any other suitable material such as other metals, filaments, glass or the like can be used as the strands in the present invention.

Figure 6:
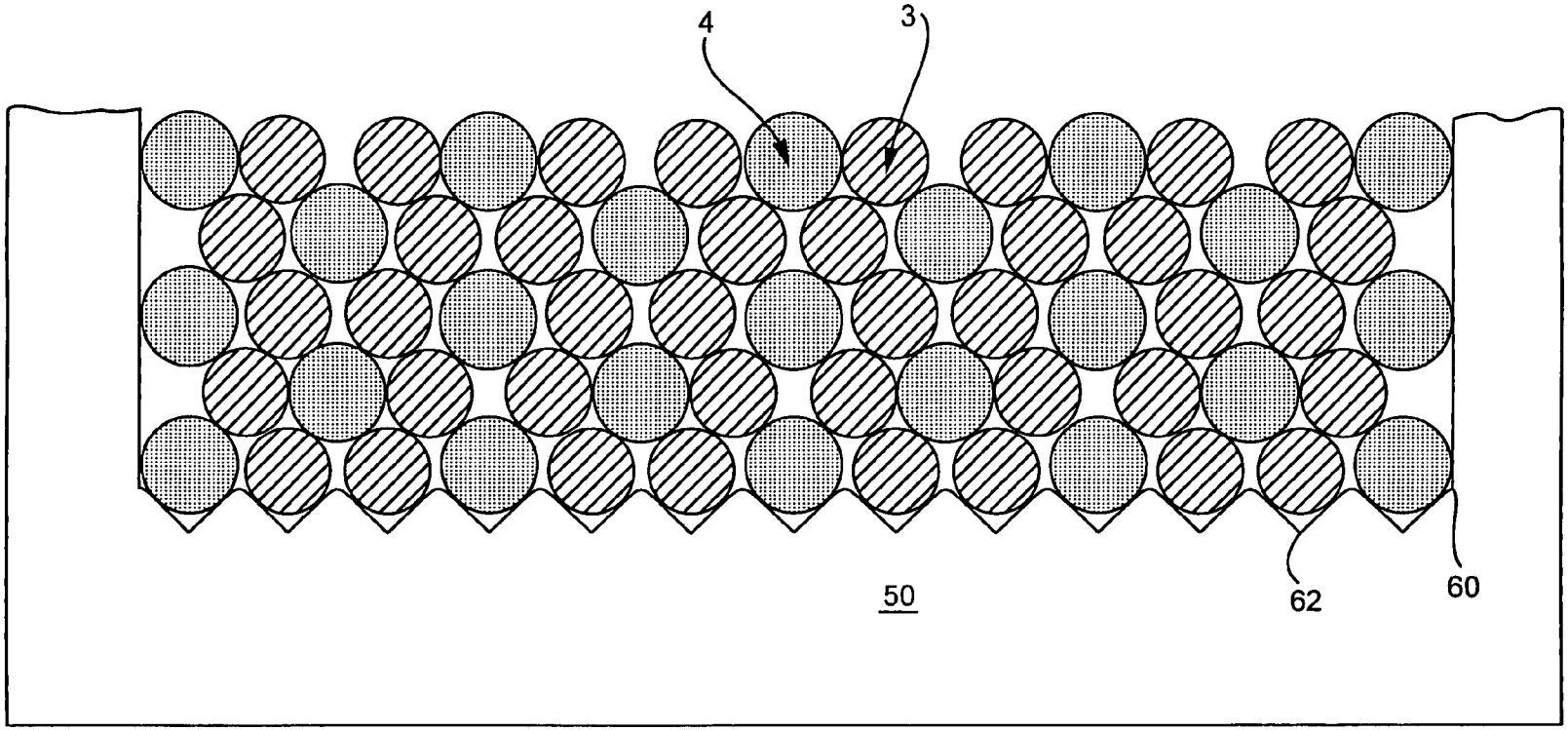
FIG. 6 illustrates a mandrel in accordance with the present invention.

The application of layers to the mandrel 50 in multiple tapes solves the problem of assembling arrays using dissimilar-sized elements or strands, but a problem in element position control at the start of the wind may nevertheless exist. In Bachelet, position control is established by applying all elements both touching and simultaneously, and therefore, the position of each element or strand is bounded by an adjacent strand. The first layer shown in FIG. 4B, however, is applied with two tapes, namely, tapes 56*a* and 56*b*. As is seen clearly in FIG. 4A, the individual strands of the first tape do not touch each other and thus do not define strand positions for each of the strands of tape 1. One solution in accordance with the present invention is shown in FIG. 6 wherein a surface 60 of mandrel 50 is machined with grooves 62 spaced in accordance with the desired strand spacing for the first and second strands of tapes 56*a*, 56*b*, respectively. With grooves 62, the elements or strands of the first tape 56*a* can be applied to the winding mandrel 50 in any sequence and the strand spacing in that first layer can be controlled throughout. The strands comprising the second layer, namely the strands of tapes 56*c* and 56*d*, subsequently become disposed in accordance with the positioning of the gaps between the strands of the first layer. All subsequent layers will thereafter follow the pattern that is established.

Figure 1A:
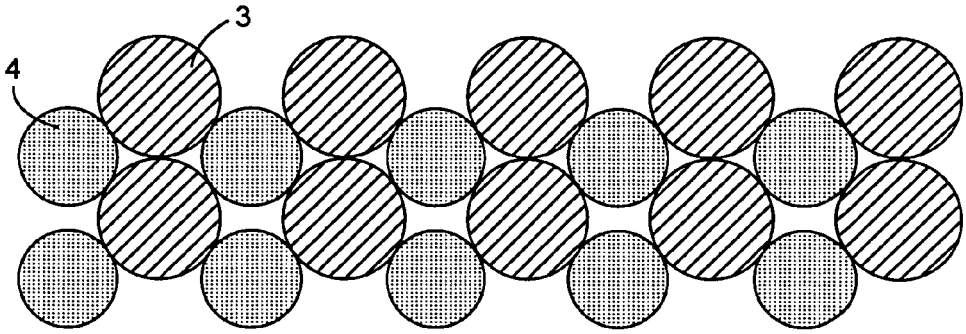
Fig. 1A (Prior Art)
FIGS. 1A-C illustrate a prior art method of assembling a wire/fiber combination.
Figure 1B:
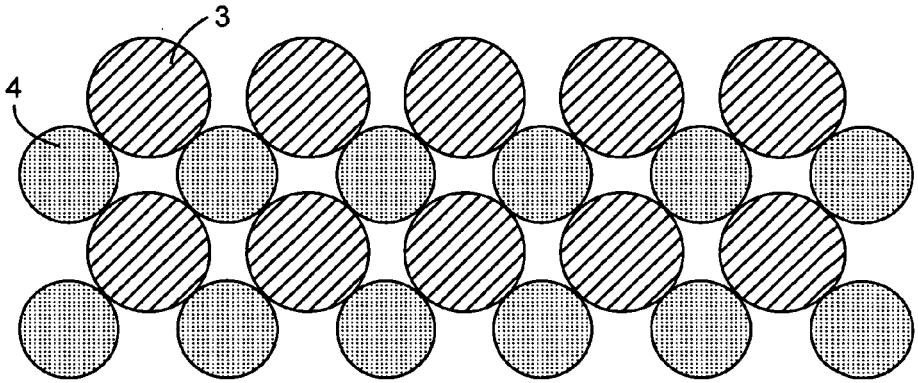
Fig. 1B (Prior Art)
Figure 1C:
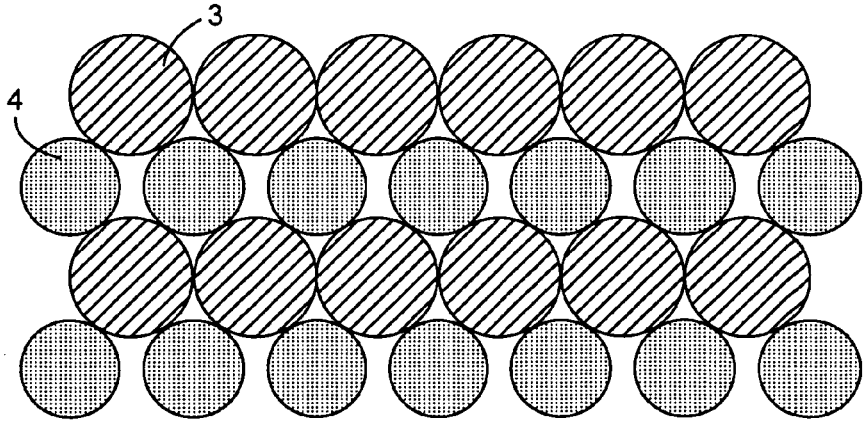
Fig. 1C (Prior Art)
Figure 2A:
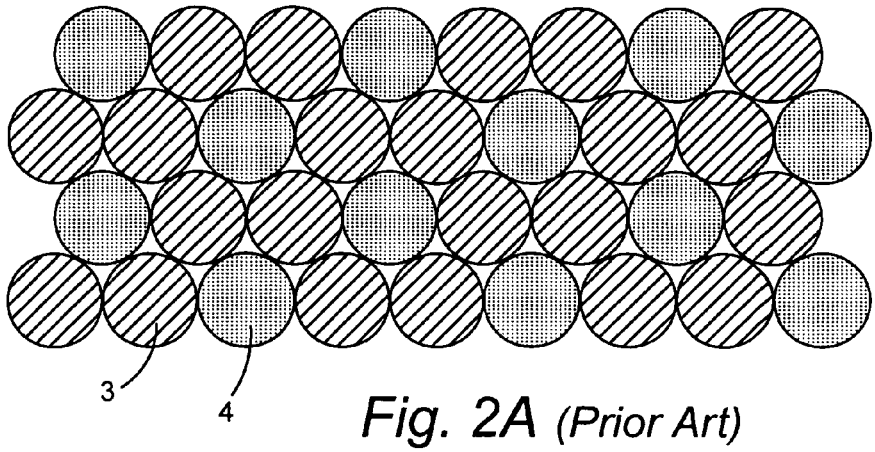
Fig. 2A (Prior Art)
FIGS. 2A-C illustrate another prior art method of assembling a wire/fiber combination.
Figure 2B:
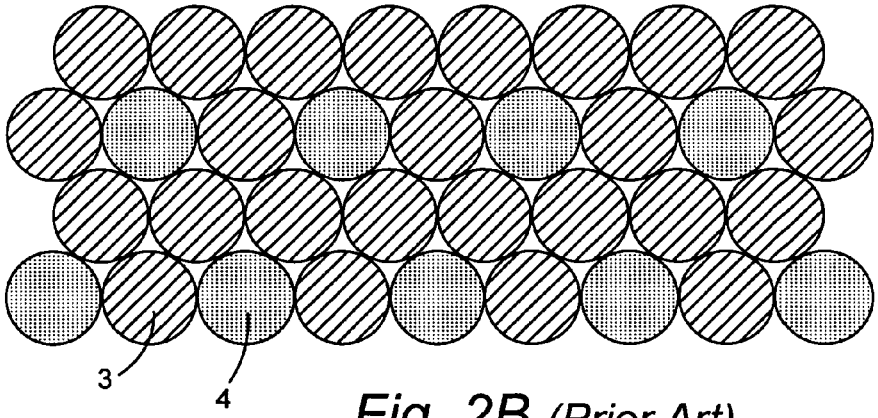
Fig. 2B (Prior Art)
Figure 2C:
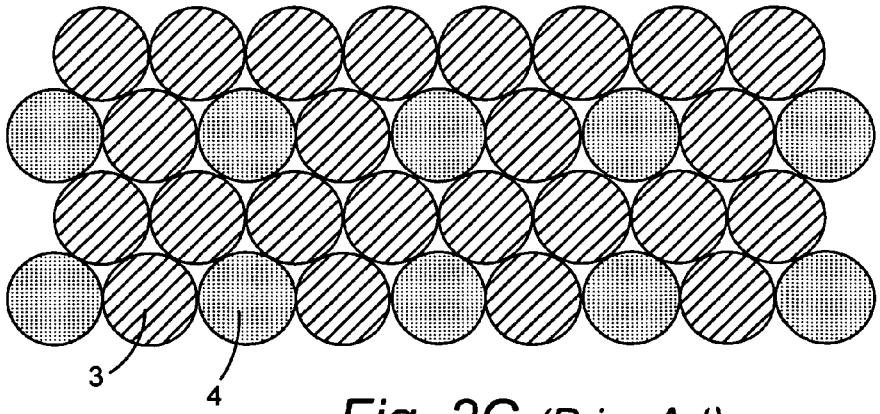
Fig. 2C (Prior Art)
Figure 3A:
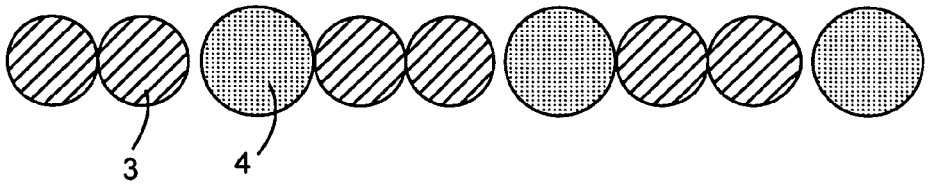
Fig. 3A (Prior Art)
FIGS. 3A-C depict the inherent instability in prior art methods of assembly wire/fiber rings.
Figure 3B:
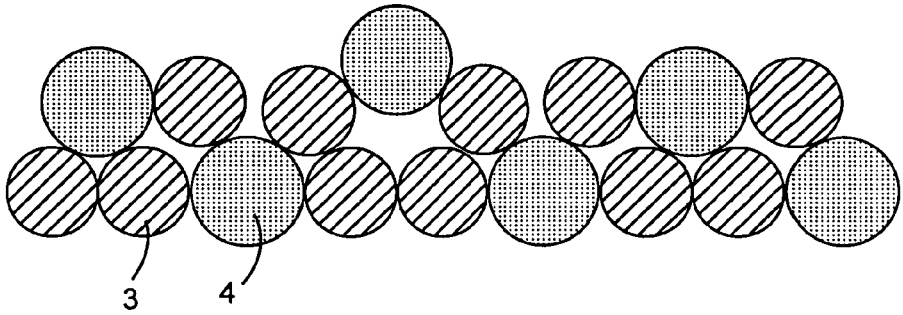
Fig. 3B (Prior Art)
Figure 3C:
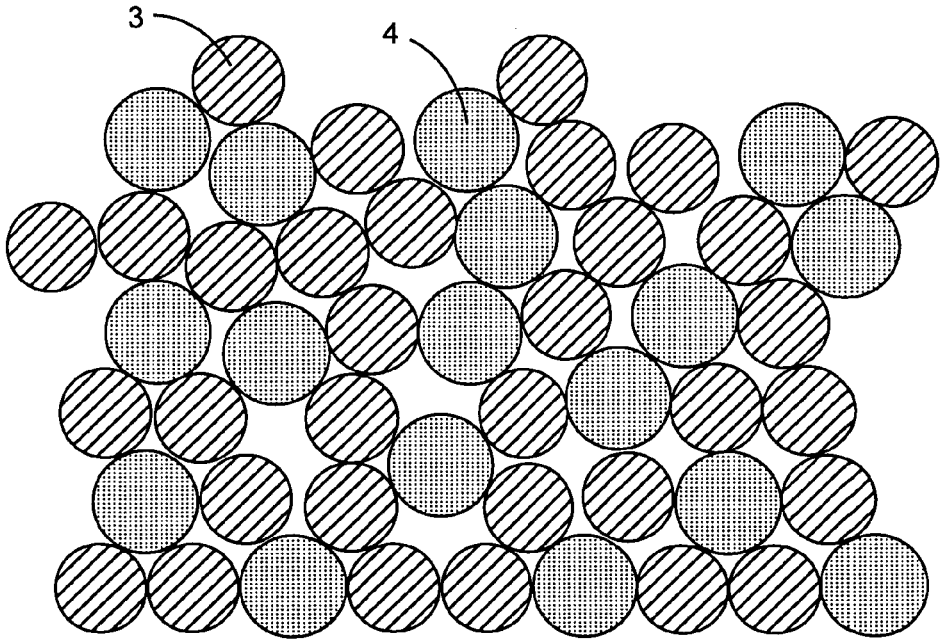
Fig. 3C (Prior Art)

The approach of using a plurality of grooves 62 on the surface 60 of the mandrel 50 reduces the constraints on wire-fiber array design. As shown in FIGS. 4A-E, an array can be reliably built-up from dissimilar-sized strands by the use of sequenced element application to the mandrel 50, and the spacing controlled as shown in FIG. 6. These examples show an array in which there are two wires to one fiber, wherein the wires 3 have a smaller diameter than the fibers 4 and all wire/fiber strands touch each other as though they had been applied to the mandrel simultaneously. The present sequential application scheme avoids the prior art stacking instability inherent in simultaneous application of dissimilar diameter elements or strands, as shown in FIGS. 3A-C.

Figure 7A:
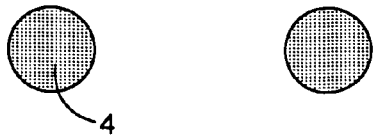
FIGS. 7A-E illustrate instability when an array is built up with two wires per fiber when the wires have larger diameters than the fibers.
Figure 7B:
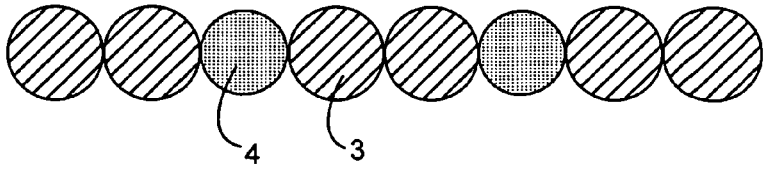
Figure 7C:
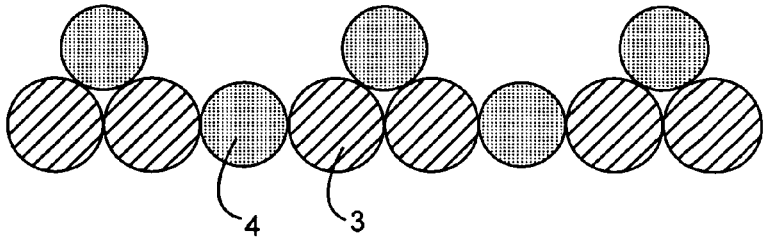
Figure 7D:
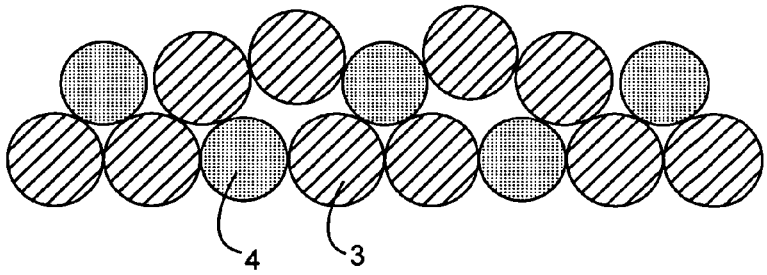
Figure 7E:
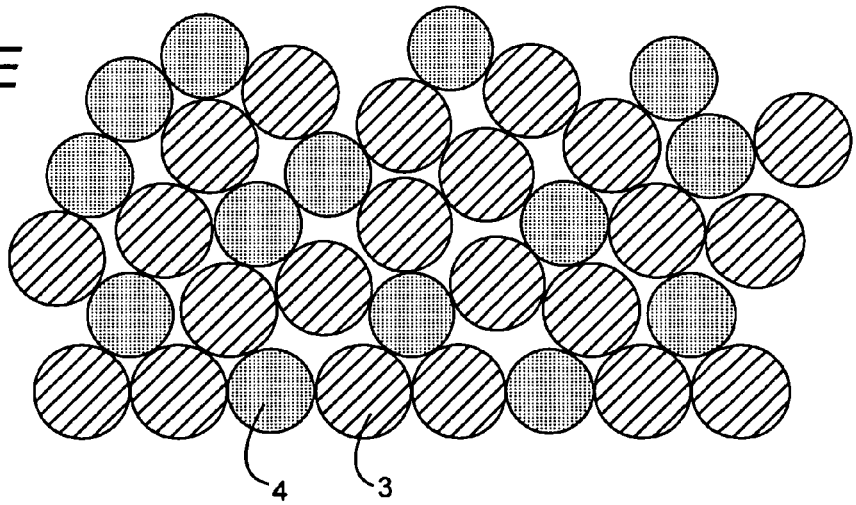

FIGS. 7A-E illustrates stacking and instability inherent with touching elements like those shown in FIG. 4 when the wires 3 have a larger diameter than the diameter of the fibers 4, i.e., in an array with a two-to-one element ratio, wherein the "two" have diameters larger than the diameters of the "one." As shown particularly in FIGS. 7D and 7E, it is only after a few layers that order is lost due to competition for nesting sites. Indeed, there is no clocking sequence that can alleviate this type of disarray. In accordance with the present invention, with the freedom to set the element spacing in the first layer independently with respect to the element diameters, the designer can control the array geometry to suit the design and broaden the range of element sites by eliminating the constraint that the "two" must be smaller than the "one".

Figure 8A:
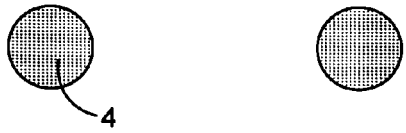
FIGS. 8A-E illustrate a build-up of multiple tapes where wires have diameters larger than the fibers, in accordance with the present invention.
Figure 8B:
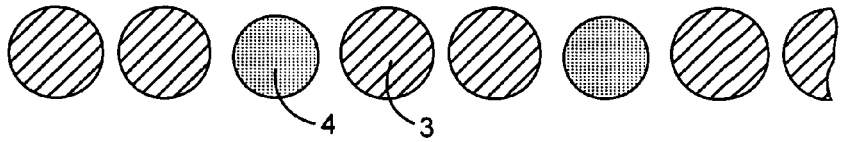
Figure 8C:
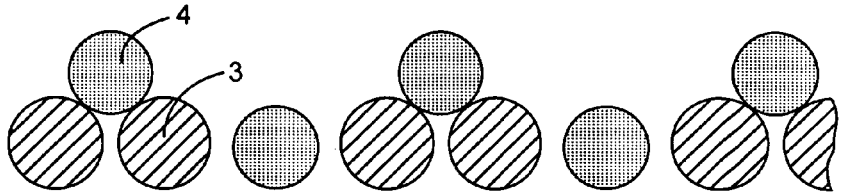
Figure 8D:
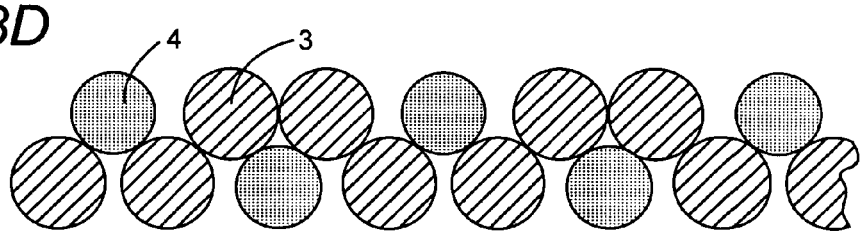
Figure 8E:
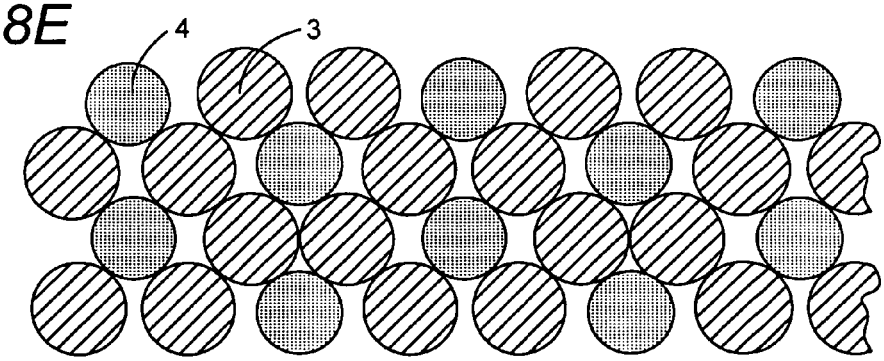

FIGS. 8A-E illustrate a reliable array build-up for the case where wires 3 have diameters larger than diameters of fibers 4 by controlling, via a grooved mandrel 50, the spacing of the individual strands in the first layer. Specifically, as shown in FIG. 8B, one of the strands in the first layer touch each other. This is possible by utilizing the grooved mandrel 50 as shown in FIG. 6. For subsequent layers as shown in FIGS. 8C-E, unambiguous nesting locations are provided since the first layer (FIG. 8B) is properly spaced.

Figure 9:
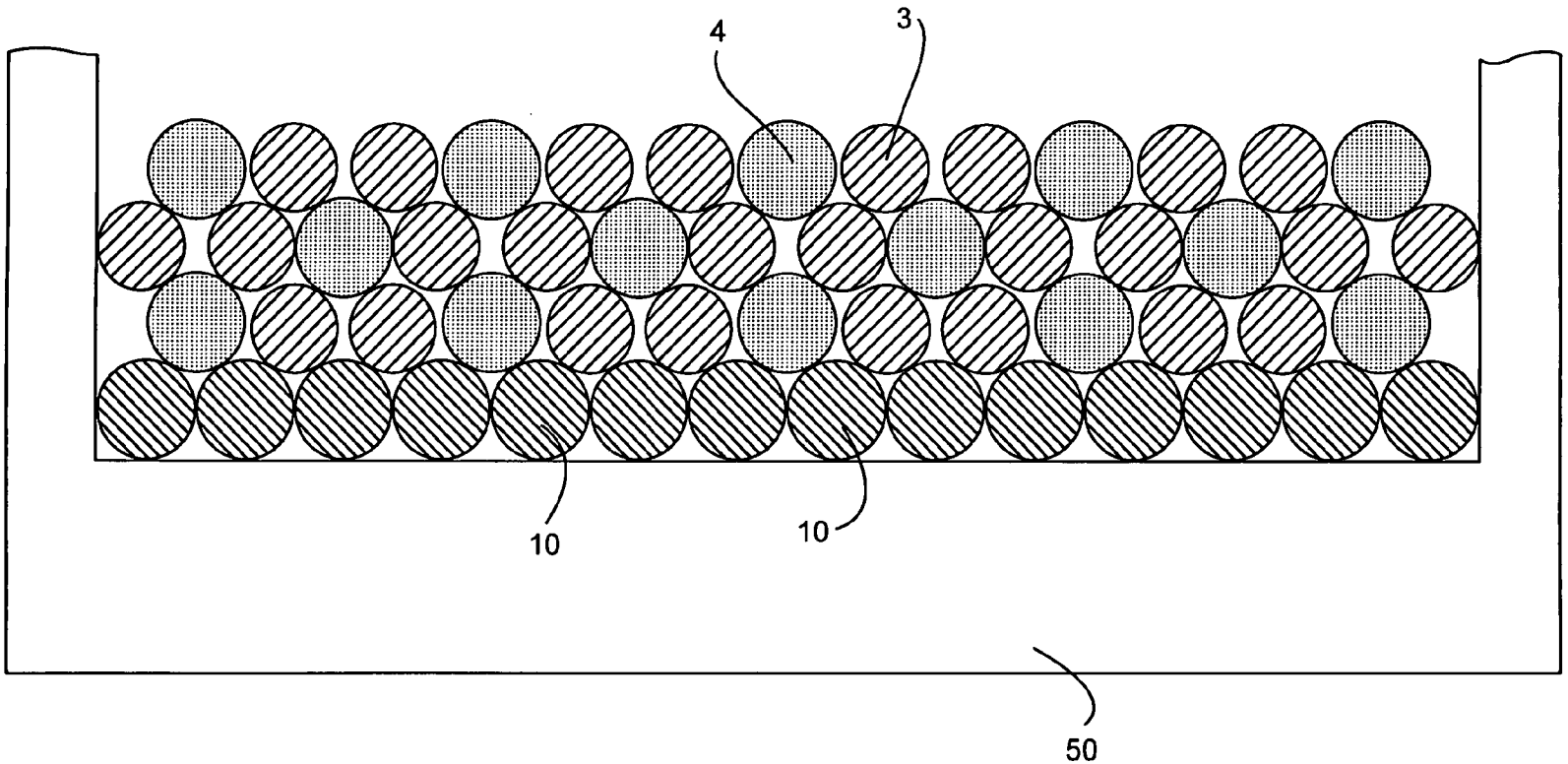
FIG. 9 depicts a mandrel utilizing wire for spacing a first layer of strands in accordance with the present invention.

The grooves in mandrel 50 can be provided in numerous affordable ways and still be effective. FIG. 6 illustrates machined grooves 62 in the mandrel 50. This approach can be relatively low in cost. Another effective method for establishing the desired spacing for wires and fibers on a mandrel is shown in FIG. 9. In this approach, spacing wire 10 is provided as a first layer wrapped around the mandrel 50. In this approach the wire diameter is selected to be equivalent to the desired element spacing, and by winding these wires in a touching manner, the desired groove pattern can be achieved also at relatively low cost without having to implement machining processes.

The description thus far has been directed to methods and structures for the assembly of a wire/fiber array that is particularly useful in the manufacture of a hoop reinforced composite ring or shaft, which are desirable in products such as turbine engine rotors and shafts. The winding operation, however results only in a "green" wire/fiber array that typically must undergo further processing to be useful as a finished ring component. Generally, as will be explained in more detail below, the subsequent processing steps include encapsulating the wire/fiber array in a suitable hardware assembly, evacuating the resulting assembly to remove gases and potential contaminants, sealing the assembly to assure maintenance of a vacuum in the internal void spaces, consolidating to remove all voids spaces and machining to the desired final dimensions.

Figure 10:
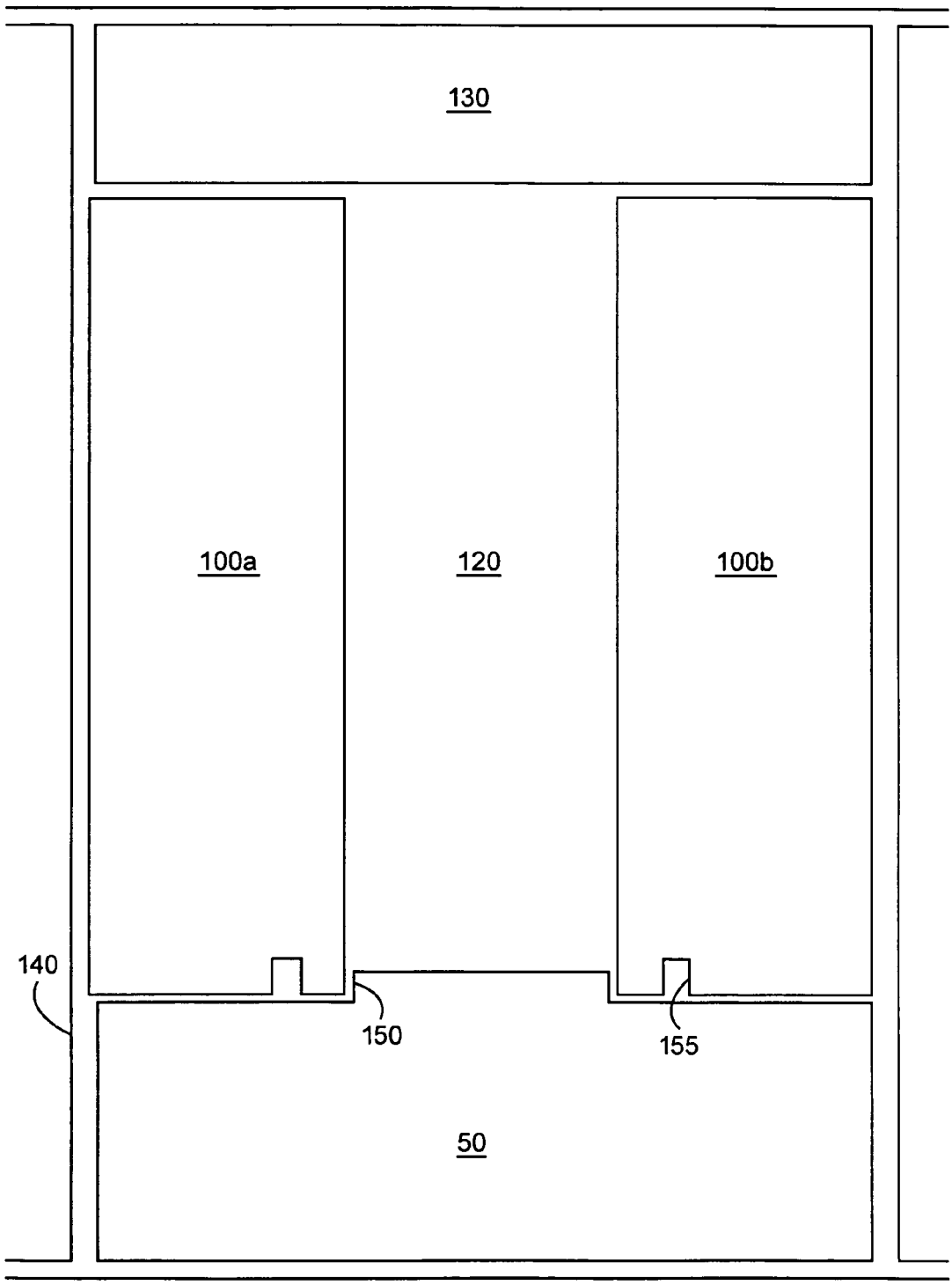
FIG. 10 illustrates a hardware set used to process a green wire/fiber assembly in accordance with the present invention.

The preferable hardware assembly comprises mandrel 50 for the assembly of the wire/fiber array, platens that press the voids out of the assembly during consolidation and metal cladding for the final component after machining. FIG. 10 illustrates a typical hardware set that is particularly useful, for example, for the case of a turbine engine rotor.

Figure 11:
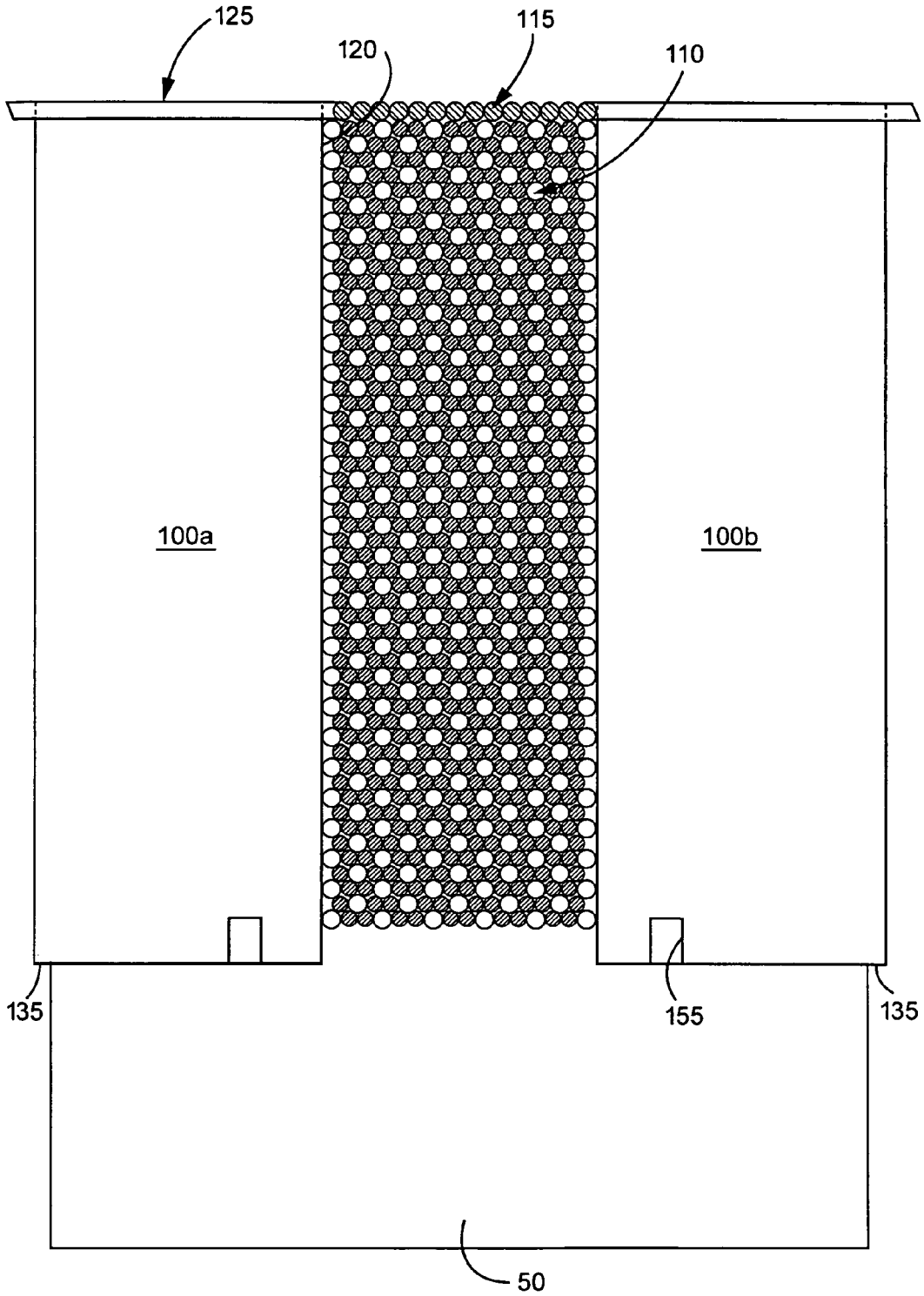
FIG. 11 depicts a hardware set with the wire/fiber assembly and over-wrap layer in accordance with the present invention.

As shown in FIGS. 10 and 11, a winding sub-assembly is first created by combining the mandrel 50 with side rings 100*a*, 100*b*. That sub-assembly is then loaded into a winding machine and a wire/fiber array 110 is built up in the manner shown in FIG. 5. The wire/fiber array 110 is thereafter temporarily held in place by adhesive attachments at the beginning and end of the roll-up to aid in assembly. As shown in FIG. 11, for permanent fixation, an over-wrap of titanium wire 115 is wound into the sub-assembly cavity 120 and attached to each side ring, via, for example, a groove 125 provided therein. The titanium over-wrap wire 115 preferably is applied by mechanical attachment such as peering into a slot on one side ring, e.g., 100*a*, winding under tension across the roll-up to form a touching layer, and mechanical attachment to the other side ring, e.g., 100*b* in the same manner. In this way, a tensioned clamping layer is provided to hold the wire and fiber elements or strands 3, 4 in place throughout the process. This is desirable since the adhesive assembly aid will be removed during a subsequent out gassing operation. If no mechanical fixation is provided, the wire and fiber strands would be free to move and control of the array geometry could be lost.

Figure 12:
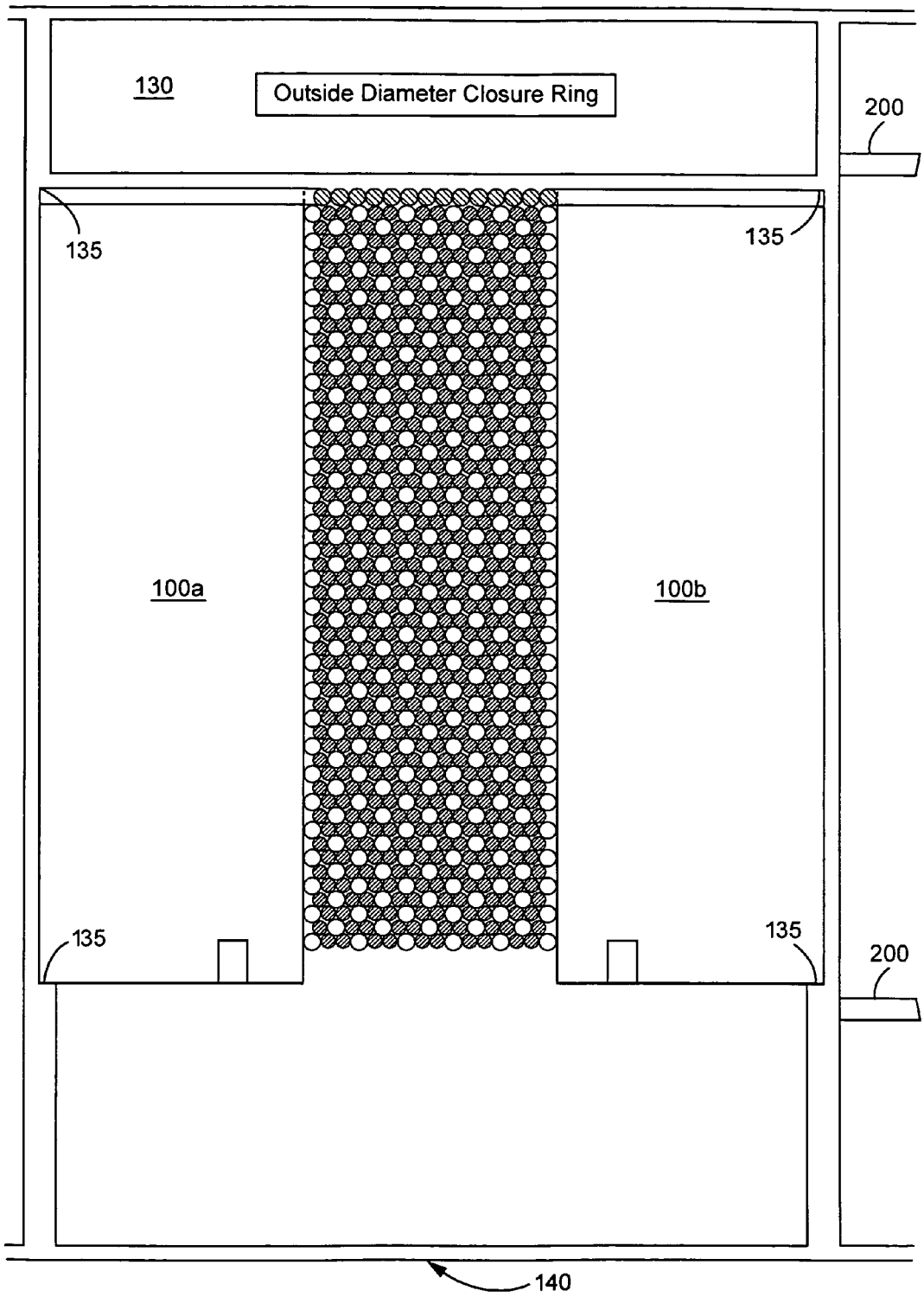
FIG. 12 depicts a hardware set with the wire/fiber assembly, over-wrap layer, closure ring and encapsulation in accordance with the present invention.

The hardware assembly is completed by sliding a closure ring 130 over the over-wrapped winding sub-assembly. The completed hardware assembly preferably is then encapsulated in a titanium sheet metal containment 140. The containment 140 provides a means for establishing a vacuum-tight container for subsequent off-gassing and consolidation operations. FIG. 12 illustrates a completed assembly encapsulated as described.

Several features about the assembly shown in FIG. 12 are of note for successful processing of the assembly. For instance, it is desirable that the consolidation of the porous wire/fiber array 110 occur in a direction parallel with respect to the axis of rotation of the ring. This is best achieved if the side rings 100*a*, 100*b* are free to move towards each other during consolidation whereby the void content is removed by axial reduction in length, while radial positions of the fibers and wires remain relatively unchanged.

While it is possible to weld directly the closure ring 130 directly to the side rings 100*a*, 100*b* to form a vacuum-sealed containment, the side rings 100*a*, 100*b* would not be able to move toward each other to achieve the desired void content removal in the desired direction. According to the present invention, mobility of the side rings 100*a*, 100*b* is maintained by avoiding permanent attachment of the side rings 100*a*, 100*b* to either the winding mandrel 50 or the closure ring 130. This achieved by having the closure ring 130 slip fit over the over-wrapped sub-assembly and thereafter encapsulating the assembly in the titanium sheet metal 140 welded at seams thereof. Additionally, the side rings 100*a*, 100*b* and the mandrel 50 are provided with a particular interface structure, shown at area A of FIGS. 10 and 11. Ideally, in the region identified by area A, a slip fit is used between the side rings 100*a*, 100*b* and mandrel 50 similar to that used between the side rings 100*a*, 100*b* and mandrel 50 similar to that used between the side rings 100*a*, 100*b* and the closure ring 130. However, the slip fit is not acceptable at this location because the side rings 100*a*, 100*b* establish the edges of the winding pattern for the array 1110 and, accordingly, are preferably accurately located and held in place on the mandrel 50. Accurate positioning of the side rings is achieved by having the side rings 100*a*, 100*b* positioned against a shoulder 150 to establish the beginning and end columns of the array 110. Additionally, the side rings 100*a*, 100*b* preferably are sufficiently thick to maintain flatness for the array as it is built-up. A problem is encountered, however, with using a thick side plate since such a side plate does not allow for easy movement during consolidation, especially when confronted with the shoulder 150.

To overcome this problem, as shown in FIG. 10 for example, a relief cut 155 is provided the side ring to permit accurate shouldering of the side rings 100*a*, 100*b* relative to the mandrel 50, but also to allow for motion of the side rings 100*a*, 100*b* during consolidation by minimizing the amount of material of the side ring 100*a* or 100*b* that must be compressed. At consolidation temperatures, the titanium metal containment 140 loses a significant amount of strength and the relief cut 155 easily collapses to accommodate the necessary side ring motion for consolidation of the array 110.

Additionally, it is noted that the interfaces between side plates 100*a*, 100*b* and mandrel 50, and side plates 100*a*, 100*b* and closure ring 130 are not securely welded to each other. Rather, the side plates 100*a*, 100*b* preferably are tack welded only to the mandrel 50 before the wire/fiber winding proceeds. Also, those interfaces preferably are not welded to form a vacuum seal. Instead, the vacuum seal preferably is achieved by encapsulating the hardware assembly in a titanium sheet metal bag 140 that is welded at the seams thereof, as previously noted. Accordingly, the side plates 100*a*, 100*b* have relatively low resistance to sliding. Relying only on the metal bag 140 for vacuum sealing is also helpful when the hardware set is composed of, for example, high performance titanium alloy which is difficult to weld.

Moreover, also as shown in FIG. 12, in accordance with the present invention, to enhance the axial sliding of the slide plates during consolidation, it can be seen that a portion 135 of the side plates 100*a*, 100*b* protrudes beyond the mandrel 50 and closure ring 130 such that during consolidation, the encapsulation bag 140 pushes first on the side rings 100*a*, 100*b*. Accordingly, movement of the side rings 100*a*, 100*b* along the desired axis is enhanced.

Still referring to FIG. 12, after the metal bag 140 is sealed, the assembly is out-gassed and consolidated to form a reinforced component blank. Specifically, evacuation tubes 200 preferably are attached to the metal bag 140 for this process and all adhesives and absorbed contaminants are removed through tube 200 by a bake-out process. In a preferred embodiment, a vacuum is applied to one attached tube 200, while a relatively low flow argon purge is applied to the other tube. The assembly is heated according to a predetermined heating profile to a temperature of about 850° F. and held at that temperature until removal of the desired volatiles is deemed to be complete. The assembly is thereafter returned to room temperature and the evacuation tubes are crimped to seal the interior of the assembly to a vacuum. The tubes 200 preferably are then crimped and cut off from the metal bag 140.

Figure 13:
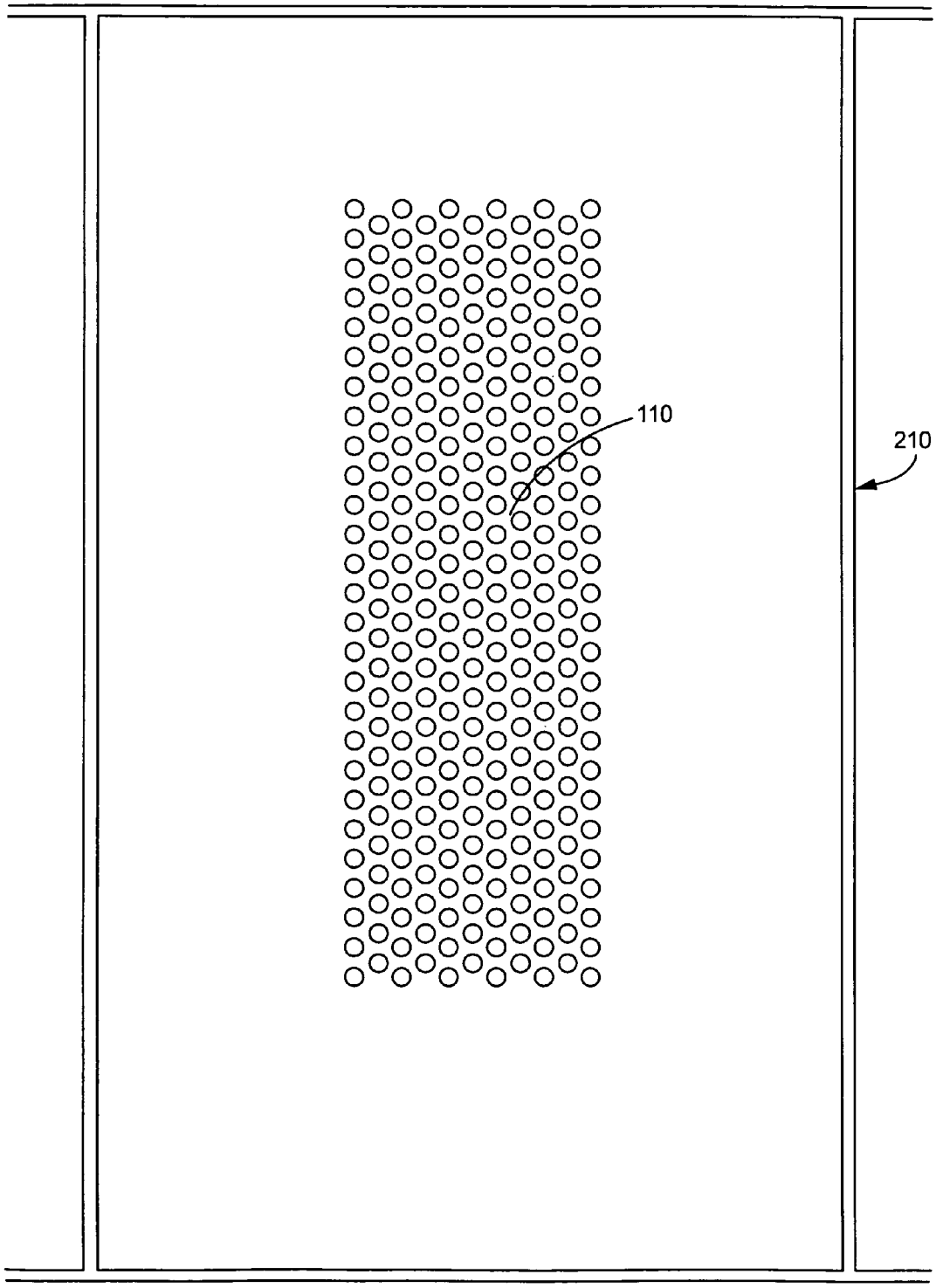
FIG. 13 shows a cross section of a fully consolidated wire/fiber ring in accordance with the present invention.

The out-gassed assembly preferably is then consolidated in a hot isostatic pressing (HIP) operation to remove voids. The assembly is heated to about 1,650° F. and a pressure of about 15,000 psi is applied to force the closure of all porosity. A section 210 of a completed reinforced blank is shown in FIG. 13.

Figure 14:
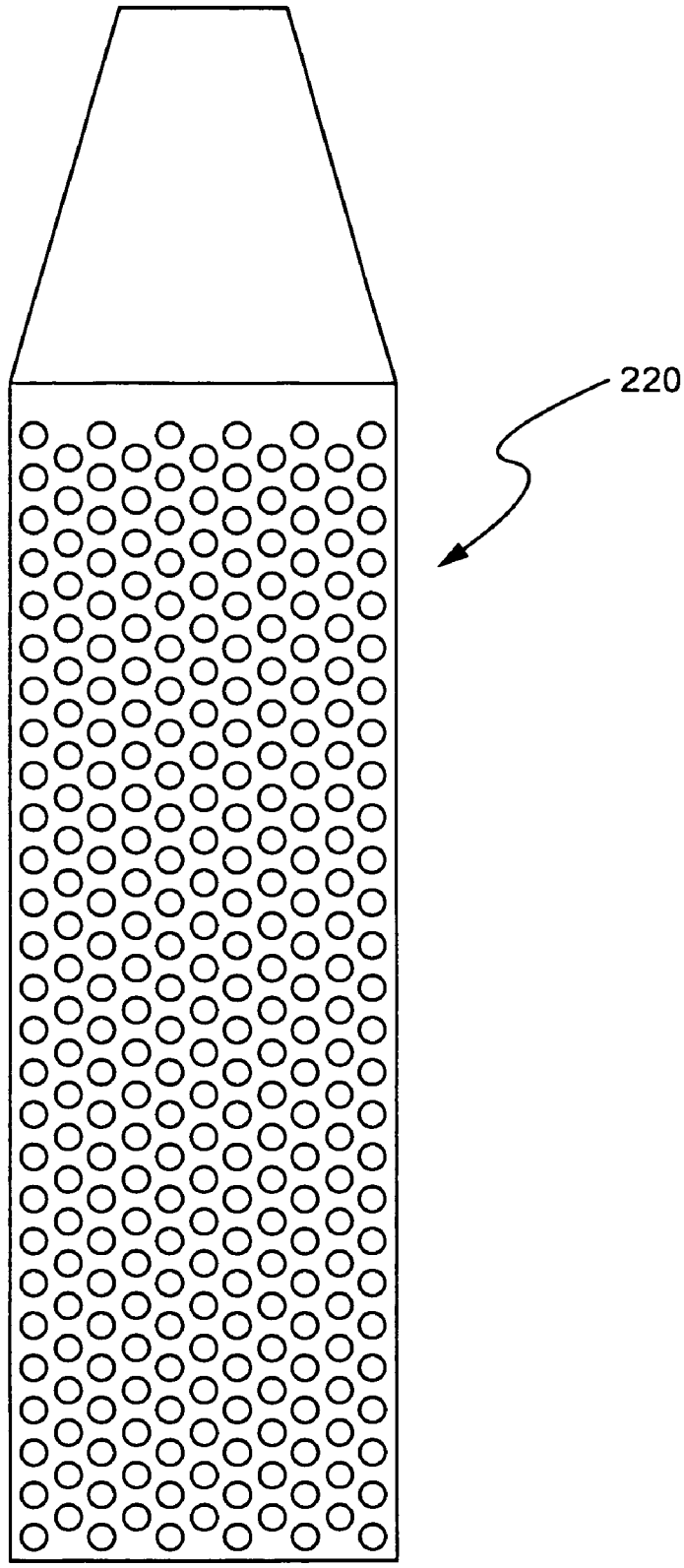
FIG. 14 shows a final machined part derived from the wire/fiber ring in accordance with the present invention.

The reinforced blank is then machined to a final desired component shape using standard machining techniques. An idealized section of a turbine engine rotor 220 that could be machined from section 210 is shown in FIG. 14.

The present invention has been described in terms of presently preferred embodiments so that an understanding of the present invention can be conveyed. The present invention should therefore not be seen as limited to the particular embodiments described herein. Rather, all modifications, variations, or equivalent arrangements that are within the scope of the attached claims should be considered to be within the scope of the invention.

What is claimed is:

1. A wire winding apparatus, comprising:

a winding mandrel;

a plurality of guide rollers each arranged at a predetermined location circumferentially around said winding mandrel; and a plurality of tapes, each being guidable by one of said plurality of guide rollers, each of said tapes comprising a plurality of strands, wherein, when said winding mandrel is rotated, each of said tapes is disposed, successively, one on top of the other on said winding mandrel, and wherein said winding mandrel has a plurality of grooves on a winding surface thereof, whereby each strand in a first layer wound on said mandrel has an unambiguous nesting position, and each strand is spaced from another of said strands in accordance with a predetermined distance.

2. A hardware set for manufacturing a wire/fiber array, comprising:

a winding mandrel having a winding surface;

a pair of side rings extending radially outward from said winding surface; and a closure ring contacting at least a portion of said side rings and enclosing an assembly space defined by said winding surface, inside surfaces of said side rings and an inside surface of said closure ring.

3. The hardware set of claim 2, wherein at least one of said side rings comprises a relief cut.

4. The hardware set of claim 2, wherein said winding surface comprises a shoulder against which at least one of said side rings abuts.

5. The hardware set of claim 2, wherein at least one of said side rings comprises a groove.

6. The hardware set of claim 5, wherein said groove accommodates an end portion of an over-wrap wire.

7. The hardware set of claim 2, wherein said closure ring is in contact with over-wrap wire that surrounds a wire/fiber assembly disposed in said assembly space.

8. The hardware set of claim 2, further comprising encapsulation means for air-tightly sealing said hardware set.

9. The hardware set of claim 8, wherein said encapsulation means comprises a metal bag.

10. The hardware set of claim 9, wherein the metal comprises titanium.

11. The hardware set of claim 8, further comprising at least one evacuation tube.

12. A wire winding apparatus, comprising:

a winding mandrel;

a plurality of guide rollers each arranged at a predetermined location circumferentially around said winding mandrel; and a plurality of tapes, each being guidable by one of said plurality of guide rollers, each of said tapes comprising a plurality of strands, wherein when said winding mandrel is rotated, each of said tapes is disposed, successively, one on top of the other on said winding mandrel, and wherein said winding mandrel comprises spacing wire immediately adjacent a winding surface of said mandrel, whereby each strand in a first layer wound on said mandrel has an unambiguous nesting position, and each strand is spaced from another of said strands in accordance with a predetermined distance.

* * * * *